United States Patent [19]

Burkle et al.

[11] 3,971,318

[45] July 27, 1976

[54] EXPLOSIVE ASSEMBLY COMPRISING A TUBULAR MEMBER FORMED OF WATER-SOLUBLE PLASTIC

[75] Inventors: William C. Burkle; Clyde W. Eilo, both of Wilmington, Del.

[73] Assignee: Hercules Incorporated, Wilmington, Del.

[22] Filed: Dec. 18, 1972

[21] Appl. No.: 316,333

[52] U.S. Cl. ..... 102/24 R; 86/20 C
[51] Int. Cl.[2] ..... F42B 3/00; F42B 3/02
[58] Field of Search ..... 102/24 R

[56] References Cited

UNITED STATES PATENTS 3,322,066 5/1967 Griffith et al. ..... 102/24

*Primary Examiner*—Leland A. Sebastian
*Attorney, Agent, or Firm*—S. Grant Stewart

[57] ABSTRACT

An explosive assembly comprising, as an intact unit in a water distended bore hole, a loading tube and an explosive loaded therein, the loading tube being formed from a water-soluble plastic material; and means for detonating said explosive.

Method for loading the explosive, comprising drilling the bore hole using a Kelly Bar type drill; retaining the Kelly Bar in the resulting bore hole and longitudinally emplacing the above loading tube therein; loading the explosive in the emplaced tube; and, either prior, or subsequent, to said loading, raising the Kelly Bar from around the tube to provide the above explosive assembly. The loading tube is capable of retaining its tubular identity in its surrounding water environment for a period sufficient to permit loading the explosive for the shot.

7 Claims, 7 Drawing Figures

EXPLOSIVE ASSEMBLY COMPRISING A TUBULAR MEMBER FORMED OF WATER-SOLUBLE PLASTIC

This invention relates to a method for loading explosives in water burdened earth formations. In one aspect this invention relates to a method for loading explosives in a water-containing, and distended, bore hole, including the steps of emplacing a water-soluble tube in the bore hole and loading the explosives into the emplaced tube for subsequent shooting as an intact column and recovery of end blasting product without contamination with debris from fragmentation of the tube. In still another aspect this invention relates to an explosive assembly for shooting in a water-containing, and distended, bore hole, including a water-soluble plastic tube and the explosive supported therein, to assure integrity of the shot and preclude contamination of the end explosive product with debris from fragmentation of the tube. Other aspects will be apparent in light of the accompanying disclosure and the appended claims.

Earth formation in certain quarrying and mining areas is porous, and contains voids of varying degree. Numerous of these formations are water burdened to the extent that water flows freely within the porous and void portions and into the bore holes drilled therein, often substantially filling them. In those instances the earth formation surrounding the bore hole is generally eroded by action of the water to cause collapse of the bore hole walls at one or more points along the bore hole length with accompanying distention of the bore hole cross-section. Hence, the bore holes are soon blocked, or constricted, to thereby impair, or preclude subsequent loading.

The practice has often been, in such instances, to drill the bore hole with a hollow metal drill stem, normally referred to as a Kelly Bar, load the explosive into the Kelly Bar while the latter is still in drilling position, and then withdraw the Kelly Bar from the hole leaving the explosive column intact. In accordance with that procedure, the Kelly Bar protects ingress of the explosive from blocking or constriction action of collapsing wall portions, so that the explosive is emplaced as an intact column. However, by action of the water and/or adjacent ground movement, portions of the explosive are often moved from the emplaced column into adjacent cavity areas in the bore hole wall and hence out of propagating relationship with the main explosive column. Accordingly, the shot may be incomplete, or it may fail. Still in other instances, the explosives may be carried by the water into adjacent fissures in the surrounding earth formation, not only then failing to detonate as part of the main charge but often, by its presence in adjacent drilling areas, impairing the safety of those adjacent operations by coming in contact with metal drilling equipment in use in those areas. To retain the Kelly Bar in emplaced position during the shot in order to assure propagation of the entire mass of the explosive independently of the degree of erosion of the bore hole wall, would not only be economically unfeasible but the tube debris resulting from the shot would contaminate the end blasting product thus seriously impairing its use.

This invention is concerned with a method for drilling in water-burdened earth structures with associated formation of water distended bore holes, utilizing a Kelly Bar drilling assembly and a loading tube introduced into the bore hole through the Kelly Bar for supporting the explosive as an intact column for the shot, without contamination of the end blasting product as above described, and, the invention is further concerned with the resulting explosive assembly.

In accordance with the invention, an explosive assembly is provided for use in a water distended bore hole, comprising as an intact unit in said bore hole, a loading tube and an explosive loaded therein, and said loading tube formed from a water-soluble plastic material; and means for detonating said explosive.

Further in accordance with the invention, a method is provided for loading an explosive in a water distended bore hole, comprising drilling said bore hole by cutting action of a Kelly Bar; retaining said Kelly Bar in the resulting bore hole and longitudinally emplacing a tube therein; said tube formed from a water-soluble plastic material and capable of retaining its tubular identity in its surrounding water environment for a period sufficient to permit loading said explosive for subsequent shooting, described herein; loading said explosive in said tube, and either prior, or subsequent, to said loading, raising said Kelly Bar from around said tube to provide said tube and explosive therein as an intact columnar explosive assembly in said bore hole for said shooting, whereby when said explosive is shot debris comprising fragments of said tube constitute substantially the only contaminant in the end blasting product and can be dissolved in the surrounding water environment by retention of said blasting product therein to provide resulting end blasting product substantially free from said contaminant.

In preferred practice, breakage of the core of earth inside the Kelly Bar during drilling is concurrently facilitated by action of a suitable core breaking means in close proximity to the cutting end of the Kelly Bar; and, in that embodiment, the core breaker is raised from the bore hole through the Kelly Bar, prior to emplacement of the loading tube therein.

The invention is further illustrated with reference to the drawings of which

Figure 1:
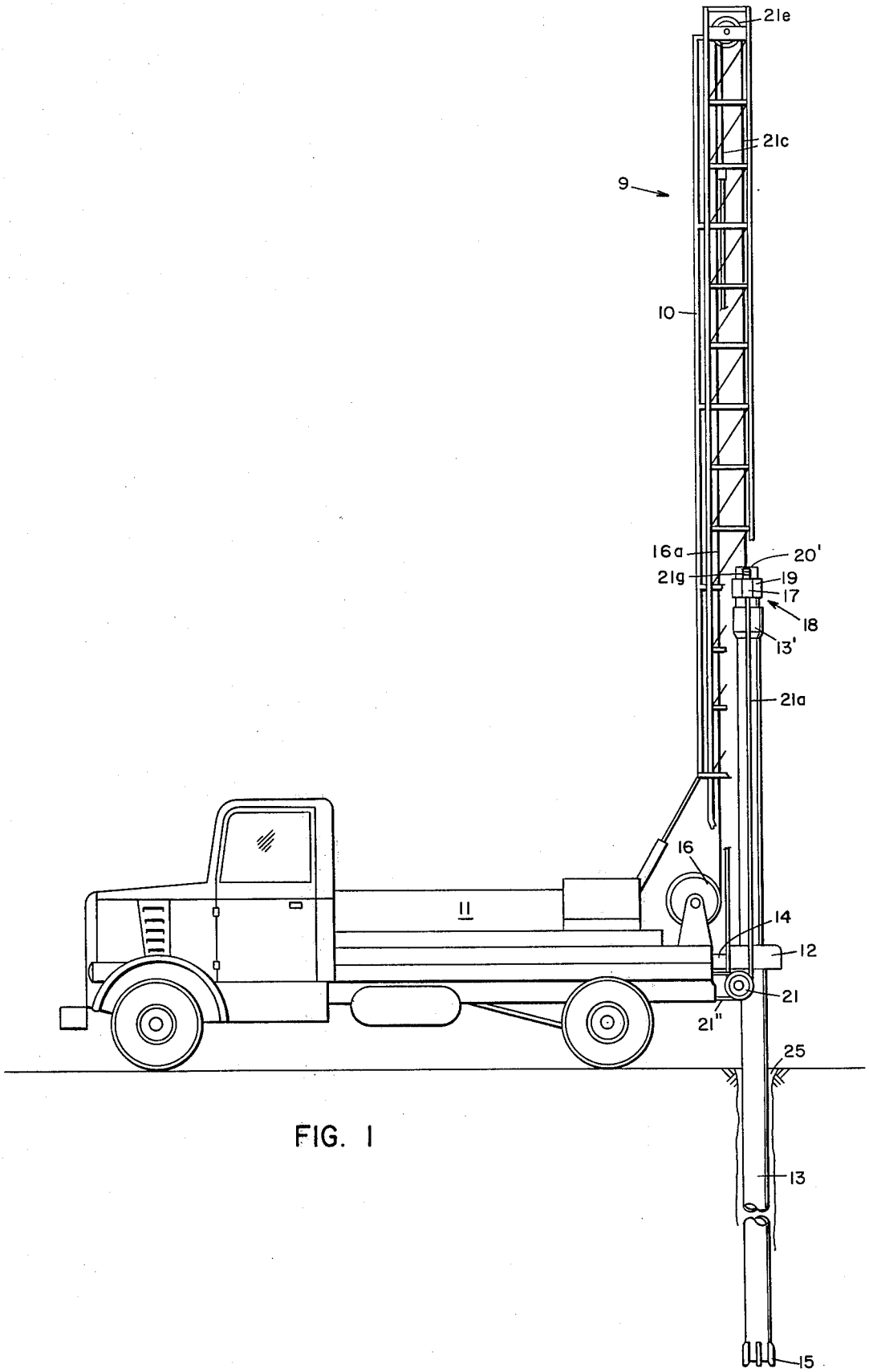
FIG. 1 is a side and diagrammatic view of a drilling rig, with Kelly Bar, suitable for supporting the Kelly Bar above ground and moving it into, and from, drilling position, and rotatably driving same for the drilling operation.

Referring to FIG. 1, drilling rig 9 includes frame, or mast, 10 shown in upright position, mounted on a conventional mobile truck unit 11 including conventional rotary table drive means 12 for engaging, and rotatably driving, hollow drill stem, or Kelly Bar, 13 in an upright drilling position. Mobile unit 11 includes suitable power take off means, not shown, operatively communicating with rotary drive table assembly 12 through shaft assembly 14 for rotatably driving assembly 12, and hence Kelly Bar 13.

Figure 2:
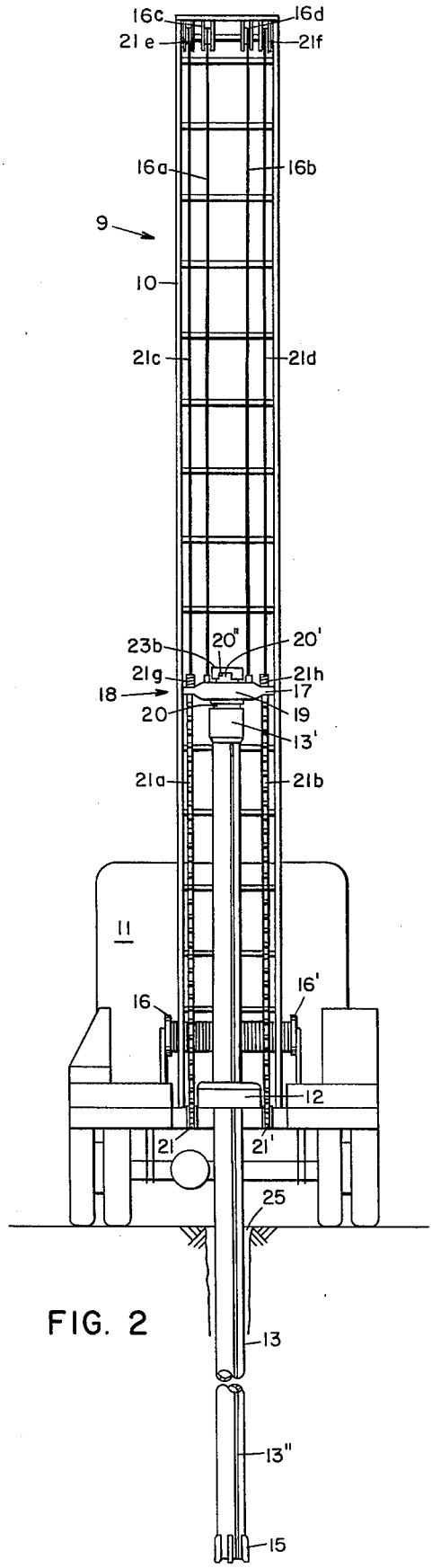
FIG. 2 is an end view of FIG. 1.

Coupler unit 18 is suspended by cables 16*a* and 16*b*, see also FIG. 2, and is adapted to engage and disengage Kelly Bar 13 at the upper end 13' thereof. Coupler 18 includes head 19, coaxially disposed male upper breech lock joint member 20', including pin 20'', for engaging a core breaker described hereinafter and coaxially disposed lower nipple 20 for threadably engaging female threaded end 13' of the Kelly Bar. Nipple 20, head 19 and joint member 20' are in open communication to form an axial passage way through which a core breaker can be emplaced in, and withdrawn from, drilling position, and through which the loading tube is optionally inserted into emplacement. Head 19 forms a cross arm 17 longitudinally extending above Kelly Bar 13 width wise, see also FIG. 2, of mast 10 centrally across the projected end of Kelly Bar 13 sufficiently to encompass Kelly Bar 13 within its extremities.

Cog wheels 21 and 21', see FIG. 2, carry chains 21*a* and 21*b* respectively and are spaced apart about 180° subjacent, and encompassing, rotary drive member 12; and they are rotatably driven by a power takeoff in unit 11, not shown, and associated chain drive means 21'', see FIG. 1. Chains 21*a* and 21*b* each connect at one end with the bottom side of cross arm 17 at spaced apart peripheral points substantially in alignment with cog wheels 21 and 21', and at the opposite end with cables 21*c* and 21*d* respectively. Cables 21*c* and 21*d* are carried by pulleys 21*e* and 21*f*, supported on mast 10 above the path of upward most travel of cross arm 17, and connect with the upper side of cross arm 17 respectively through spring coil members 21*g* and 21*h* secured to cross arm member 17 at spaced apart points in close proximity to the connecting ends of chains 21*a* and 21*b* at the bottom side of cross arm 17.

Cable reels 16 and 16', see also FIG. 2, are supported at spaced apart points adjacent rotary drive means 12 on a line substantially parallel to that connecting cog wheels 21 and 21', and they are rotatably driven by power takeoff means in unit 11, not shown. Cables 16*a* and 16*b* carried respectively by reels 16 and 16' extend upwardly and around pulleys 16*c* and 16*d* supported as a unit with pulleys 21*e* and 21*f* on mast 10, into connecting relationship with the topside of arm 17 at spaced apart points in close proximity to spring member 21*g* and 21*h*.

Rotatable Table 12, of conventional design, including a central longitudinally extending passageway therethrough (not shown), engages Kelly Bar 13 extending through that passageway, by any suitable means such as by engagement of a female key way longitudinally extending on the inner wall of the central passageway (not shown) with longitudinally extending male key 13'' on the exterior of Kelly Bar 13.

As Kelly Bar 13 is rotatably driven during the drilling step, power takeoff means in unit 11 rotatably drives cog wheels 21 and 21' to, in turn, move chains 21*a* and 21*b* to impart downward pulling action on the cross arm 17 to bias the Kelly Bar in drilling position. During this period of operation, cables 16*a* and 16*b* are unwound without applied tension, from reels 16 and 16'. Travel of Kelly Bar 13 to the bottom most position is accomplished when the top end 13' thereof is in close proximity to the drive 12 platform, such as of FIG. 2. Biasing tension on chains 21*a* and 21*b*, at the end of the drilling step, applied through cog wheels 21 and 21', is relieved by disengagement of the cog wheels from the power takeoff in unit 11.

Figure 3:
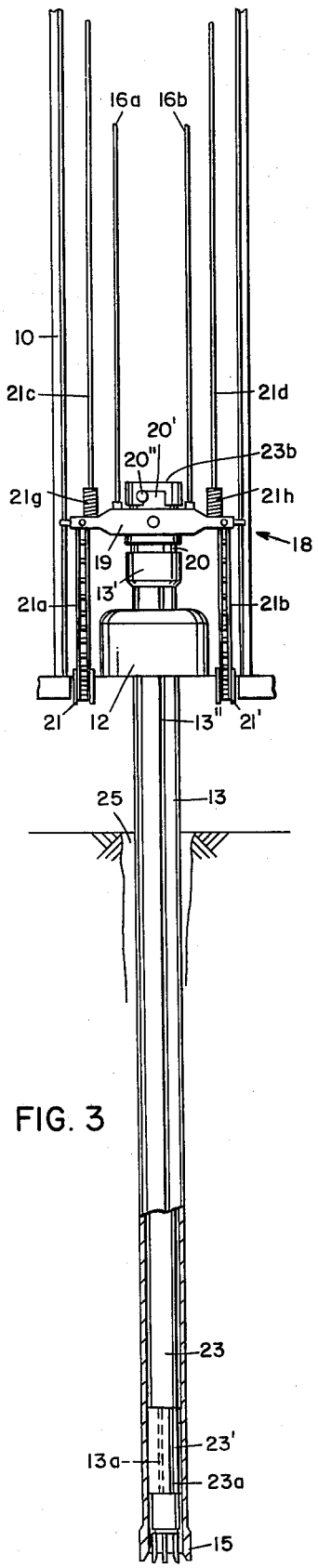
FIG. 3 is a view including a more detailed portion of FIG. 2, and also showing a core breaker unit at the cutting end of the Kelly Bar to supplement the drilling and breaking operation.

Optionally, a core greaker 23, see FIG. 3, extending through Kelly Bar 13 is locked within the Kelly Bar at the cutting end 15 thereof, such as by slidable engagement of longitudinally extending female key 23*a* at the bottom end 23' of core breaker 23 with the male key way 13*a* on the inner wall at the bottom end of Kelly Bar 13. During the drilling step a stream of water, or a pressurized air stream, is generally passed into an upper end of the Kelly Bar by means not shown, and through the cutter end 15 to wash cuttings from within, and along the outside of the Kelly Bar, to the ground surface. The core breaker, which rotates with the Kelly Bar, assists in further reducing the size of the broken core material to facilitate its removal from the bore hole. In those embodiments in which the Kelly Bar also contains a core breaker 23, the latter must first be withdrawn from the Kelly Bar prior to insertion of the loading tube.

Figure 4:
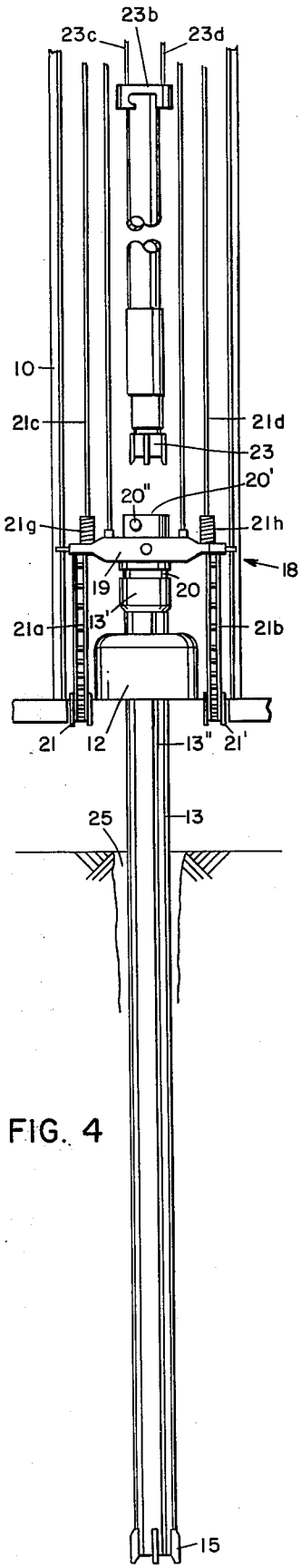
FIG. 4 is the same as FIG. 3 except that it shows the Kelly Bar after removal of the core breaker and prior to emplacement of the loading tube.

When a core breaker 23 is utilized, it is inserted, optionally longitudinally through head 19 and into Kelly Bar 13 prior to the drilling step so as to engage the female keyed end of the core breaker with the male threaded lower end 13*a* of the Kelly Bar to thereby lock the core breaker in rotating relationship with the Kelly Bar. The top end 23*b* of core breaker 23, see FIGS. 3 and 4, forms the female end of a breech lock joint for engaging top end 20' of coupler 18, after locking Kelly Bar 13 and core breaker 23 in the above described keyed relationship. The breech lock joint is formed by twisting the key locked Kelly Bar-cross breaker to engage the pin 20'' in locking relationship with joint member 23*b*. As illustrated with reference to FIG. 4, at the end of the drilling step, the breech lock is disengaged by twisting the locked Kelly Bar-core breaker assembly clockwise sufficiently to free pin 20'' from locked relationship with the end member 23*b*. Core breaker 23 is then lifted from Kelly Bar 13 by action of cables 23*c* and 23*d* carried by pulley means not shown. Similarly, the core breaker 23 can be lowered for emplacement in the Kelly Bar, by suspension from cables 23*c* and 23*d*.

Figure 5:
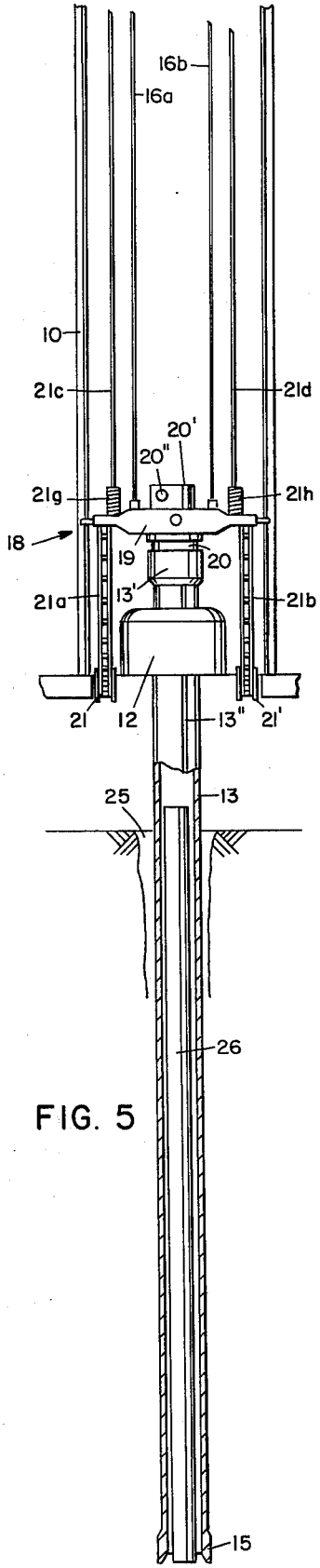
FIG. 5 is the same as FIG. 4 except that the core breaker structure of FIG. 4 is not shown and the loading tube has been coaxially inserted through the coupler 18 into the Kelly Bar.

By any suitable means, as illustrated with reference to FIG. 5, plastic water-soluble loading tube member 26, after withdrawal of the core breaker 23, when utilized, is substantially concentrically emplaced within Kelly Bar 13. In the embodiment shown, loading tube 26 is inserted longitudinally through head member 19 and gravitated into emplacement. Optionally, dependent on the relative diameters of the loading tube and the Kelly Bar, the coupler 18 can be first disengaged from the Kelly Bar prior to emplacement of the loading tube. Kelly Bar 13 is withdrawn from around loading tube 26 as shown in FIG. 6, and the loading tube 26 can be loaded with explosive for the shot either prior to or subsequent to withdrawal of the Kelly Bar.

Figure 6:
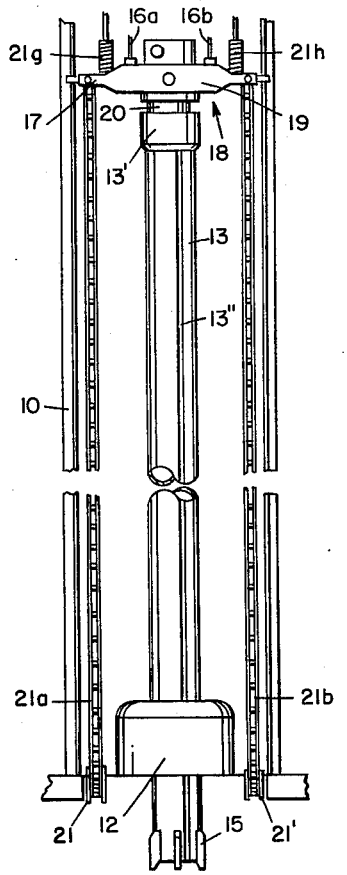
FIG. 6 shows the assembly of FIG. 5 after withdrawal of the Kelly Bar from operating position.
Figure 6:
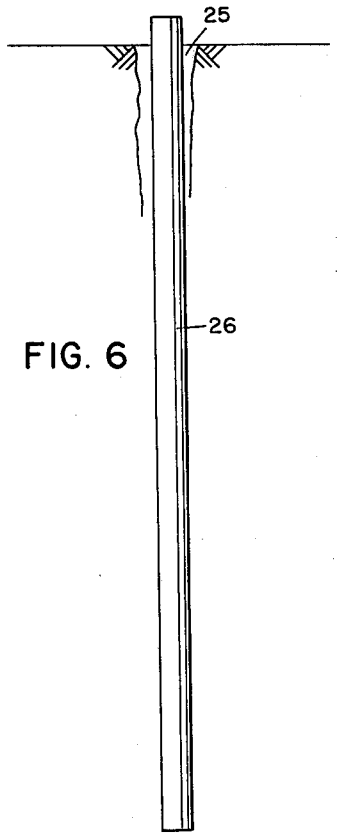

In preferred practice the Kelly Bar is withdrawn from the bore hole by lifting action of cables 16*a* and 16*b* in engagement with coupler 18 to provide the loading tube in the bore hole ready for loading, as shown in FIG. 6. However, if desired, the Kelly Bar can be retained in the bore hole and the loading tube loaded with explosives for the shot with subsequent removal of the Kelly Bar from the bore hole. In all events whether the Kelly Bar is removed prior to or subsequent to loading of the plastic loading tube with explosives, the final assembly for the shot comprises the water-soluble plastic loading tube emplaced, and charged with explosive, as shown in FIG. 7.

Figure 7:
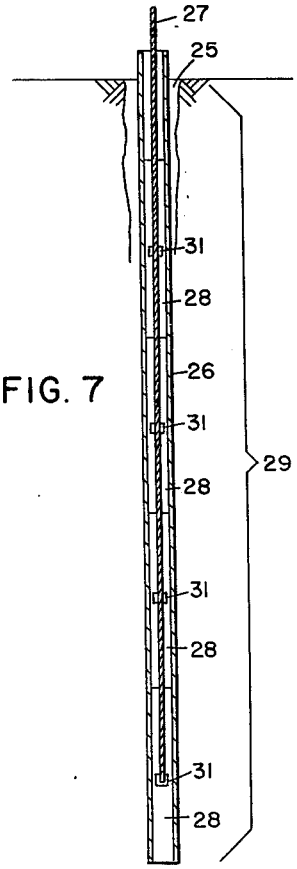
FIG. 7 is the same as FIG. 6 except that it omits the rig structure of FIG. 6, and shows the explosive, along with detonator means therefor, emplaced in the loading tube, in readiness for the shot.

As further illustrated in FIG. 7, the emplaced loading tube 26 is loaded with suitable explosive charge, such as a plurality of main explosive cartridges 28 to form an intact explosive column 29, with detonator fuse 27, extending lengthwise along column 29 in detonating relationship with suitable boosters 31 at spaced apart points in column 29.

The integrity of the column 29 of explosive in the water distended bore hole 25 is, of course, maintained by loading tube 26. Although the water solubility properties of the plastic loading tube 26 vary dependent on the particular plastic material, the loading tube remains intact in the water generally over a period of at least 4 hours, thus affording sufficient time for loading and shooting the intact explosive column. Fragments of the loading tube resulting from detonation of the explosive charge are dispersed among the breakage product and unless removed they constitute contaminants in the end blasting product to impair use of the latter in many instances. However, as provided in practice of the invention, the fragments of loading tube are dissolved in the water environment after the shot so the end product is free from such contaminant materials. Generally upon permitting the broken earth formation to stand in the surrounding water environment for a period of at least 6 hours, often up to 24 hours or longer, the fragmentary plastic material contaminant dissolves in the surrounding water environment to provide substantially contaminant-free, end explosive product.

As illustrated with reference to the drawings, the now preferred process embodiment of the invention comprises the steps of drilling the bore hole in the water burdened earth formation utilizing the Kelly Bar and core breaker assembly, as described; lifting the core breaker from the Kelly Bar and then emplacing the loading tube coaxially into the Kelly Bar utilizing a length of loading tube in sufficiently close proximity to the ground surface to permit loading same with explosive charges often at a distance above ground in the order of about 1 ft.; withdrawing the Kelly Bar; and loading the loading tube with the explosive charge. In pattern shooting, in accordance with the invention, it is preferred from the standpoint of safety to successively drill a plurality of bore holes, with emplacement of the loading tube in each instance before proceeding to drill the next hole, but to not load any explosive until the drill assembly has moved to a remote point. In this manner, there is never a drilling operation adjacent the explosive in a loaded bore hole, and hence there is never a possibility of direct contact of the Kelly Bar with explosive in the adjacent bore hole.

Although the length of the loading tube is somewhat in excess of the portion of Kelly Bar within the completed bore hole, the loading tube can be made up of a single, or plurality of, sections. Separate lengths can be connected in any suitable manner such as by suitable breech lock means, or by adhesive strips on the outer wall of the tube, longitudinally extending from one section to another.

Although the plastic loading tube can be formed from any suitable water-soluble plastic material, hydroxypropyl cellulose, known commerically as "Klucel" is now preferred. The preferred hydroxypropyl cellulose (Klucel) can be prepared by mixing cellulosic material, alkali, water and a water immiscible inert organic diluent, removing excess liquid from the resulting alkli cellulose, and then causing the alkali cellulose to react with the propylene oxide. The water soluble plastic product (Klucel) is soluble in cold water, insoluble in hot water, soluble in polar organic solvents and is thermoplastic; and it has an M.S. of from 2–10, more often 3–5, by which term is meant the average number of moles of reactant combined with the cellulose per anhydroglucose unit. The thermoplastic hydroxypropyl cellulose product (Klucel), and its manufacture, are further described in U.S. Pat. No. 3,278,521, which for that purpose is incorporated herein by reference. Other suitable water soluble plastics from which the loading tube can be formed, include polyvinyl alcohol, polyethylene oxide, methyl cellulose and hydroxypropyl methyl cellulose.

Often, an inert filler can be advantageously incorporated into the plastic material for economic reasons without impairing its function in practice of the invention. For example, finely divided talc, or limestone, can advantageously be utilized as extender materials in the plastic. The use of limestone in the Klucel material is especially advantageously applied in the drilling of water burdened limestone formations inasmuch as the residual limestone from the dissolved plastic fragments returns to the end product as a part thereof, and hence with no undesirable contamination of the product.

The invention is further illustrated with reference to the following examples:

15 boreholes were drilled in a water bearing porous limestone formation containing voids of varying degree, and substantially water-filled, utilizing an assembly of FIG. 1 of which the Kelly Bar had an I.D. of 2 ½ inches, and an O.D. of 5 inches, and a 4 ¾ inches drilling bit. Subsequent to completion of each hole the water-soluble loading tube was emplaced in the Kelly Bar. Each loading tube was 30 feet in length and was formed from three 10-foot sections taped in alignment with a ¾ inch Permacel tape. The hole depths were 29 ½ ft. with the exception of three holes of which one was 24 ft. and two had a depth of 27 ft.

In each instance the water soluble loading tube was 2 inches I.D. by 2 3/16 inches O.D., and was formed from Klucel/limestone 50:50 weight ratio, and was extended from the slightly above ground level into and along substantially the entire length of the bore hole.

Upon emplacement of the loading tube, in each instance, and prior to loading same with explosive, the Kelly Bar was withdrawn from the bore hole. All bore holes were drilled in a 7 ft. by 7 ft. pattern. In each of ten of the bore holes 24 to 27 packaged 1 ½ inches by 12 inches aqueous gel ammonium nitrate slurry type explosive units were lowered into the tube to form a column of contiguous explosive units, of which one, located near the bottom of the hole, contained an electric blasting cap, thus serving as a detonator for the explosive column. Semi gelatin type dynamite in 12 to 13 1 ½ inch by 24 inch packages, with one, near the bottom of the hole, containing an electric blasting cap to thereby serve as a detonator for the explosive column, was loaded in each of the five remaining bore holes.

The porous limestone formation containing the bore holes was substantially water filled up to a level of about 2 ft. below ground surface.

Each loading tube, after emplacement, was retained in position for a period of time prior to loading in order to assure that the location of the withdrawn Kelly Bar, placed in subsequent operation, would at all times be remote to the emplaced tube member, thereby to preclude any possibile contact of the metal Kelly Bar with explosive while drilling adjacent a loaded bore hole. The time period of emplaced loading tube exposure in the water-filled formation was determined by the drilling pattern, and hence the time necessary for the drill unit to be moved into operation at a point remote to the particular emplaced tube, the maximum exposure time being about 6 hrs. In all instances the loading tube and column of explosive contained therein remained intact and the explosive was detonated.

The fragmentary loading tube material subsequent to the detonation was initially in admixture with the end explosive product, but due to its water solubility dissolved in the surrounding water after a period not exceeding about 6 hrs. thus being removed from the end product as a water solution providing substantially contaminant free limestone end product. The limestone ingredient of the water soluble plastic tube material although not water soluble was retained in the end limestone product as a noncontaminating ingredient.

The wall thickness of the water soluble plastic loading tube is correlated with its water solubility, and hence temperature of the water in contact therewith, in order that its rate of solution in the surrounding water, does not impair its integrity as an intact unit during a minimum initial period often, say about 1 hr. and in many instances of from 4 to 6 hrs. Integrity of the tube member over such a period, affords sufficient time for withdrawal of the Kelly Bar from the tube and for pattern drilling of a plurality of additional bore holes prior to loading the particular tube with explosive. Generally, a wall thickness of from about 1/16 to ¼ inch is sufficient for retaining the desired period of integrity of the loading tube.

Although any suitable explosive material can be loaded into the loading tube in practice of the invention, the tube is generally loaded with aqueous inorganic oxidizer salt-type slurry explosives in packaged, or bulk form, the latter by pumping action or by displacement from a vessel under air or water pressure. When charging a pourable type slurry explosive, loading can advantageously be accomplished by cutting through the wall of each individual explosive package and permitting the slurry to gravitate through the water into emplacement in the bore hole.

As will be evident to those skilled in the art, various modifications can be made or followed in light of the foregoing disclosure and discussion without departing from the spirit of the disclosure or from the scope of the claims.

What we claim and desire to protect by Letters Patent is:

1. An explosive assembly for use in a water-distended borehole, comprising as an intact unit in said borehole, a tubular member and an explosive contained therein; said tubular member formed in its entirety from a water-soluble plastic material, and having its wall thickness correlated with its water solubility so that its rate of solution in the water in contact therewith does not impair its integrity as an intact tubular unit during an initial period of at least about one hour in said water contact; and means for detonating said explosive.

2. An explosive assembly for use in a water-distended borehole, comprising as an intact unit in said borehole, a tubular member and an explosive contained therein; said tubular member formed in its entirety from a hydroxypropyl cellulose having an M.S. of from 2–10 and having its wall thickness correlated with its water solubility so that its rate of solution in the water in contact therewith does not impair its integrity as an intact tubular unit during an initial period of at least one hour in said water contact.

3. An explosive assembly of claim 1 wherein said tubular member is formed from a water-soluble plastic material selected from the group consisting of polyvinyl alcohol, polyethylene oxide, methylcellulose, hydroxypropylmethyl cellulose, and a hydroxypropyl cellulose having an M.S. of from 2–10.

4. An explosive assembly for use in a water-distended borehole, comprising as an intact unit in said borehole, a tubular member and an explosive contained therein, and said tubular member formed in its entirety from a hydroxypropyl cellulose having an M.S. of from 2–10; and means for detonating said explosive.

5. An explosive assembly of claim 4 wherein said hydroxypropyl cellulose material contains an inert filler ingredient.

6. An explosive assembly of claim 5 wherein said inert filler is of the group of talc and limestone.

7. An explosive assembly of claim 6 wherein said water-soluble plastic material contains up to 50 weight percent limestone.

* * * * *

UNITED STATES PATENT OFFICE

CERTIFICATE OF CORRECTION

Patent No. 3,971,318 Dated July 27, 1976

Inventor(s) William C. Burkle et al.

It is certified that error appears in the above-identified patent and that said Letters Patent are hereby corrected as shown below:

Column 4, line 6, "greaker" should read -- breaker --.

Column 5, lines 66 to 68, "material, hydroxypropyl cellulose, known commercially as "Klucel" is now preferred"." should read -- material, a now preferred plastic is hydroxypropyl cellulose, known commercially as "Klucel". --.

Signed and Sealed this

Sixteenth Day of November 1976

[SEAL]

*Attest:*

RUTH C. MASON
*Attesting Officer*

C. MARSHALL DANN
*Commissioner of Patents and Trademarks*